United States Patent [19]

Simpson

[11] Patent Number: 5,048,701

[45] Date of Patent: Sep. 17, 1991

[54] PRODUCT MERCHANDISER ASSEMBLY

[76] Inventor: Peter C. Simpson, 1430 Watersedge Road, Mississauga, Ontario, Canada, L5J 1A4

[21] Appl. No.: 568,975

[22] Filed: Aug. 17, 1990

[51] Int. Cl.[5] ..... A47F 5/00

[52] U.S. Cl. ..... 211/189; 211/133; 248/220.2

[58] Field of Search ..... 211/59.1, 189, 186, 211/126, 133, 88, 90; 248/220.2, 220.3, 222.2, 249

[56] References Cited

U.S. PATENT DOCUMENTS 3,198,344 8/1965 Lindgren ..... 211/88
4,205,815 6/1980 Sauer et al. ..... 248/222.2 X
4,560,062 12/1985 Valiulis ..... 248/220.3 X
4,687,094 8/1987 Allsop et al. ..... 211/88
4,705,175 11/1987 Howard et al. ..... 211/59.1 X

*Primary Examiner*—Robert W. Gibson, Jr.

[57] ABSTRACT

A product merchandiser assembly of the present invention comprises a product receiving member, an elongated arm, and a clip for slipping the product receiving member onto the arm. The arm includes a mounting end for mounting the arm from a support in a suspended position outwardly away from the support. The clip is fitted directly through the product receiving member onto the elongated arm.

3 Claims, 4 Drawing Sheets

PRODUCT MERCHANDISER ASSEMBLY

FIELD OF THE INVENTION

The present invention relates to a product merchandiser assembly.

BACKGROUND OF THE INVENTION

There are many different types of product merchandiser assemblies available. It is known to provide a product merchandiser box which is fastened to a much larger supporting structure immediately behind the box. In such an arrangement, the supporting structure which generally has no use other than to support the box, occupies more space than the box itself. Therefore, there is not only limited use of the supporting structure, but in addition, the floor space occupied by the overall assembly makes them both costly and awkward to use.

SUMMARY OF THE PRESENT INVENTION

The present invention provides a product merchandiser assembly in which the components of the assembly itself maximize the use of the space required for the assembly. In fact, according to one aspect the assembly of the present invention is compatible with an in use product merchandiser without restricting or limiting the use of that merchandiser.

More particularly, the product merchandiser of the present invention comprises a product receiving member, clip means and an elongated arm. The clip means fits directly through the product receiving member onto the elongated arm to hold the entire assembly together.

The elongated arm has a mounting end which mounts directly to a supporting structure and a hanger region which is suspended outwardly from the supporting structure. The supporting structure may comprise an already in-use support, preferably in the form of a standard shelf set up. The assembly of the present invention, while using the support provided by that standard shelf set up does not in any way take away from the existing shelf space.

The support for the assembly may also be specifically designed for the assembly in which case the support, although requiring a solid foundation only needs to be large enough to receive the mounting end of the elongated arm which is substantially smaller in size than the product receiving member maximizing the efficient use of space by the assembly.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
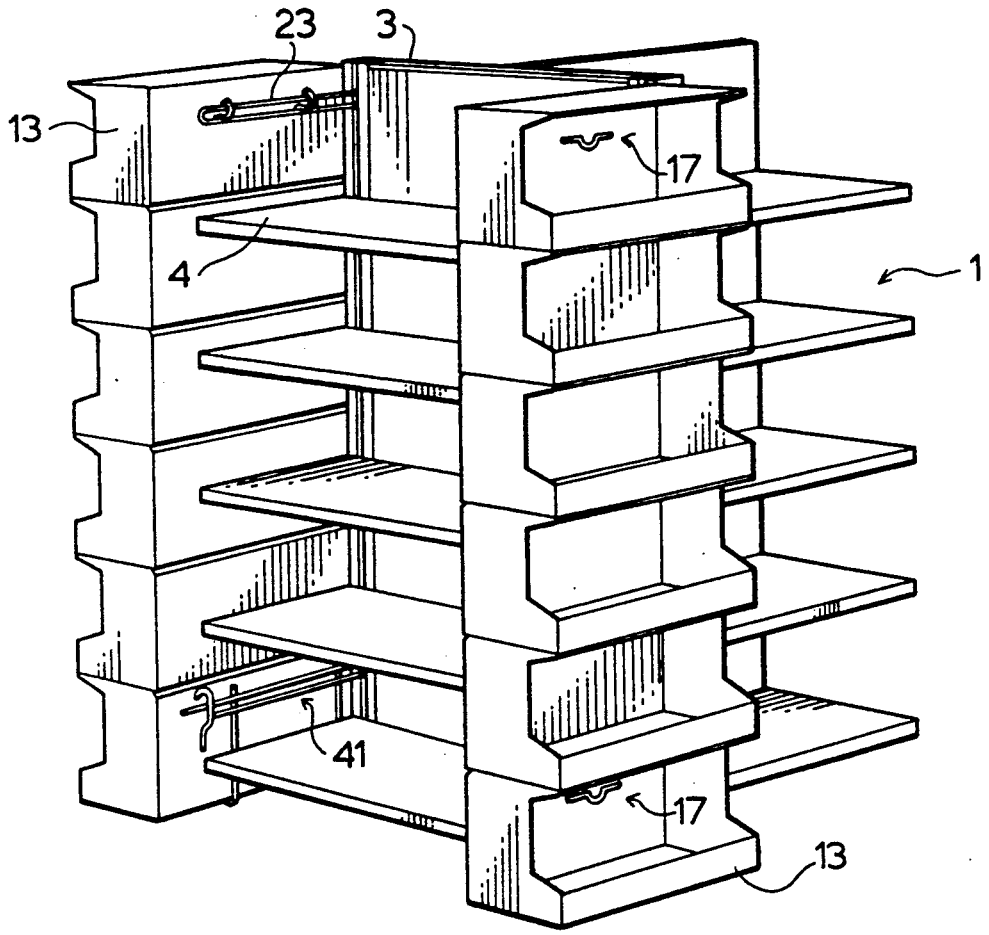
FIG. 1 is a perspective view of a shelf structure used to support a product merchandiser assembly according to a preferred embodiment of the present invention.

FIG. 1 shows an overall product merchandiser generally indicated at 1. This product merchandiser includes a generally standard shelf system comprising a plurality of horizontally extending shelf panels 4 and a backwall support 3 for the shelf panels.

In accordance with the present invention, further product merchandiser assemblies are added as end units to the existing shelf system. It would be noted that these end units in no way take up existing shelf space, although they do rely on the backwall 3 for their support as will be described later in detail. It is also to be noted that the ends units are beneficial to the existing shelf system in that they protect against product falling off of either end of the open shelves.

Figure 2:
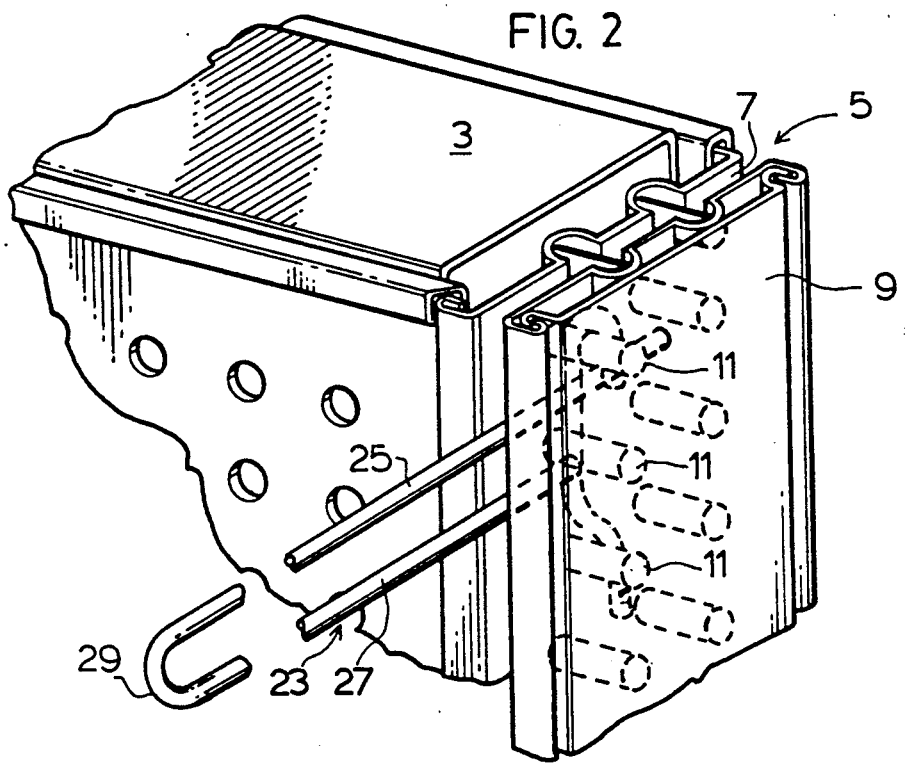
FIG. 2 is a detailed perspective view showing the mounting of the hanger arm of the product merchandiser of FIG. 1 to the shelf backwall support.

FIG. 2 shows greater detail of the backwall support 3 of the shelf system and in particular, the end region generally indicated at 5 of the backwall. This end region comprises a pair of end covers or plates 7 and 9 secured to one another by a plurality of interlocking pegs or posts 11. As will be seen in FIG. 2 of the drawings, there is a slight gap between the two end plates.

Figure 5:
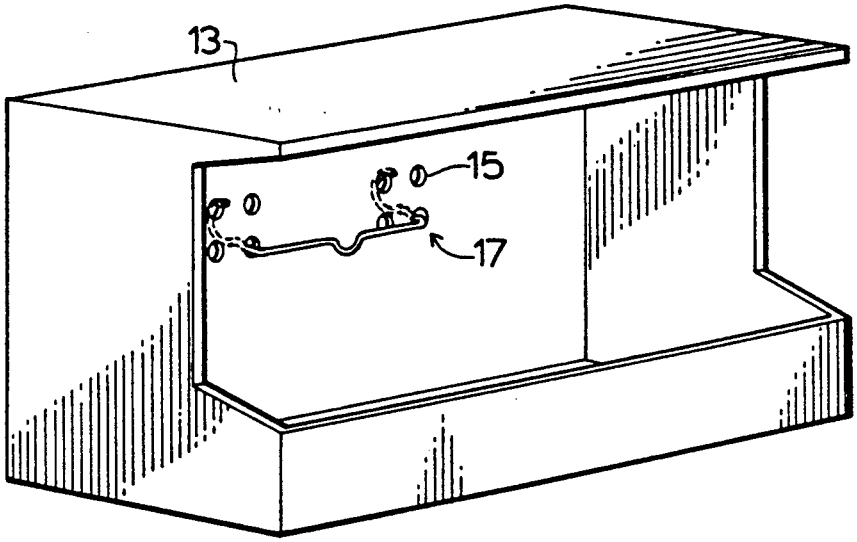
FIG. 5 is a perspective view of the product merchandiser member from the assembly of FIG. 1.

The merchandiser assembly of the present invention comprises at least one and preferably a plurality of product receiving members 13 best seen in FIG. 5 of the drawings. These product receiving members preferably made from cardboard are light in weight but have a sufficiently rigid construction for supporting product placed in the merchandisers. In the FIG. 1 arrangement, a plurality of box like structures 13 are vertically interlocked with one another in two stacks, one stack at either end of the open shelves 4.

Figure 6:
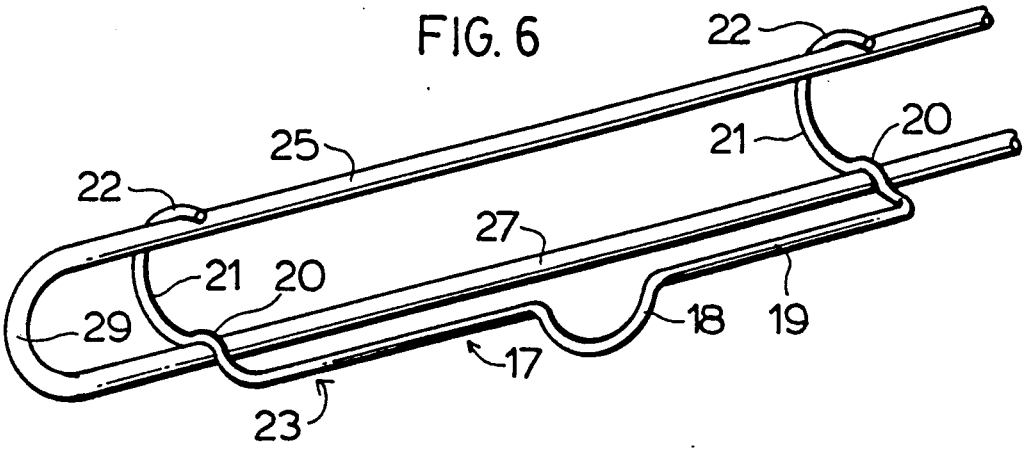
FIG. 6 is an enlarged perspective view of the clip from the product merchandiser assembly of FIG. 1.

Each of the boxes 13 has an open front and a rear wall 14 provided with a plurality of apertures 15. These apertures are used to receive a clip 17, the construction of which is best seen in FIG. 6 of the drawings and to be described later in detail.

In the arrangement shown in FIG. 1, a clip 17 is used at both the top and bottom box in each stack. At the top box, the clip secures to an elongated arm or hanger arm, generally indicated at 23 and well seen for example in FIGS. 3 and 4 of the drawings. This hanger arm is in the preferred embodiment of the present invention formed by upper and lower arm portions 25 and 27 respectively which are joined at the outer end 29 of the hanger arm. The hanger arm further includes a mounting end generally indicated at 31 which comprises an upper hook portion 33, a small horizontally extending leg portion 35 which is a continuation of arm portion 25 extending beyond hook portion 33 and a lower multi-angled generally vertically extending leg 37.

Figure 3:
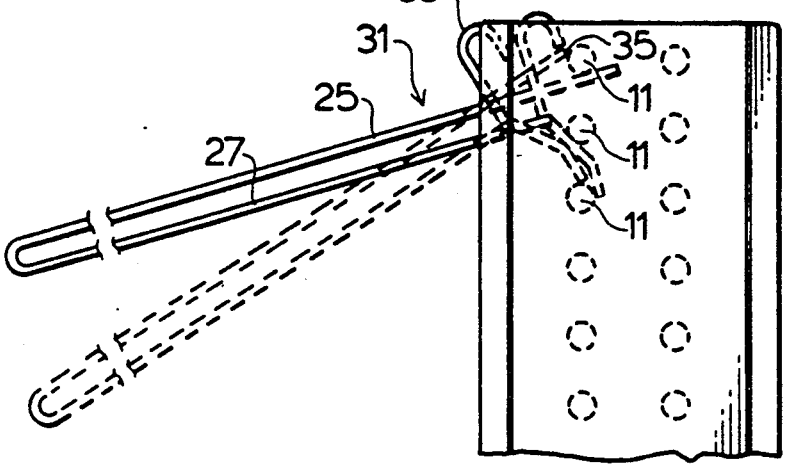
FIGS. 3 and 4 show the stages of mounting of the hanger arm of FIG. 2 to the shelf backwall support.
Figure 4:
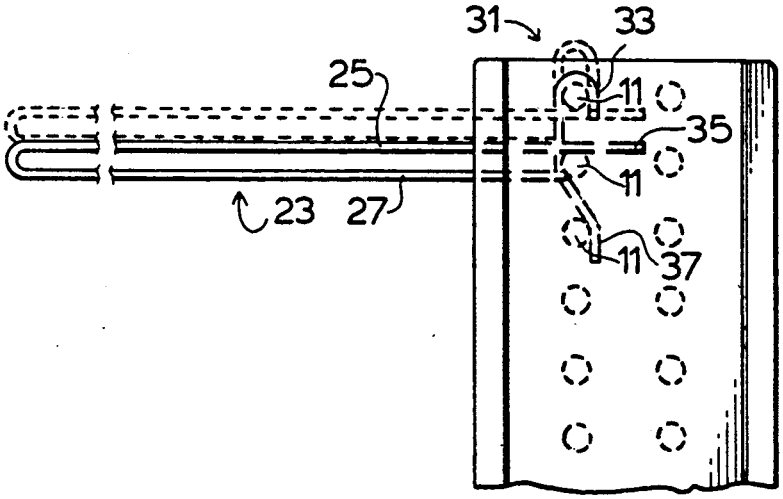

The mounting end 31 of hanger arm 23 is particularly designed to fit with the end region 5 of the shelf panel backwall 3 shown in FIGS. 2 through 4 of the drawings. In this particular arrangement, a plurality of the pegs or posts 11 are set up in a vertical line and arm 23 is mounted by simply fitting it in the gap between the cover plates 7 and 9 and dropping hook portion 33 at the mounting end of the arm down over one of those pegs as seen in FIGS. 2 and 4 of the drawings. The small horizontally extending arm portion 33 sits atop the peg or post immediately beneath the peg or post onto which hook portion 33 has been fitted. The downwardly angled vertical portion 37 then wraps around the post immediately beneath the post atop which arm portion 35 is seated. This provides an extremely effective yet releasable mounting of arm 33 in a manner to prevent the arm from moving away from its horizontally extending position as shown in FIG. 2 of the drawings. Furthermore, the thickness of the arm is such that it substantially fills the gap between cover plates 7 and 9 to prevent any sideways movement of the arm.

As will be seen in the drawings, both the upper and lower arm portions 25 and 27 of arm 23 are secured back to the mounting end of the arm in a spaced apart manner which adds substantially to the overall strength and the non-moving support provided by the mounting end of the arm.

Figure 11:
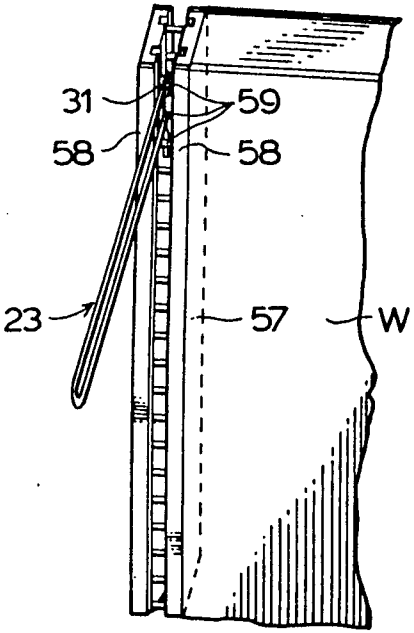
FIG. 11 is a perspective view of a support member designed specifically to receive a hanger arm for the merchandiser assembly of the present invention.

The description above relates to support of the hanger arm from an existing shelf structure. FIG. 11 shows a further preferred embodiment of the present invention in which a support for the mounting arm is specifically designed to fit with the merchandiser assembly of the present invention.

More particularly, a support 57 which is formed by a pair of slightly gapped plates 58 is mounted directly to a wall W or any other similar foundation for the support 57. A plurality of small posts or pegs 59 fill the gap between the two plates 58 with hanger arm 23 having mounting end 31 fitting on these pegs or posts 59 in the identical manner to that described above.

In either of the two set ups described above, it will be seen that the relatively small hanger arm simply hangs out into open space away from the support. In the FIGS. 1 and 2 set up, the support is already provided and therefore, does not necessitate an additional support to be provided specifically for the merchandiser assembly. In the FIG. 11 set up the support 57 while being sturdy occupies very little space and will not extend across the back of the merchandiser box other than through the hanger arm 23.

Regardless of the set up, the arm after having been mounted presents an elongated hanger region suspended by its mounting end for receiving clip 17 which is first fitted through the backwall of the product receiving member 13 as shown in FIG. 5 of the drawings. The clip itself includes a front bar 19 with a finger grip 18. Hook portions 21 are provided to either end of the clip and these hook portions include upwardly bent regions 20. When the clip is mounted, the front bar portion 19 fits up tightly against the front of the backwall of the product merchandiser box 13 with the hooks 21 extending through the apertures in the backwall of the box. The upwardly bent regions 20 of the hook portions 21 seat atop the lower hanger bar arm 27 while the upper ends 22 of the hook portions 21 wrap around the upper arm 25 of the hanger bar to a point where they just touch against the back of the box. In this position the finger grip 18 fits flat against the front of the backwall of the product receiving box where it is out of the way but in a very accessible position for removing the clip from the assembly when desired.

The use of the closed end on the hanger is very beneficial in that it takes a deliberate action to place the clips 21 onto the lower leg of the hanger arm with the upper leg blocking the clips from easily being knocked upwardly off of the arm. At the same time, the clips are horizontally adjustable by simply sliding them along the arm which by virtue of its closed outer end will not allow the clip from sliding completely off of the hanger arm.

As seen in FIG. 5, the backwall 14 of the product receiving member 13 may be provided with a plurality of sets of apertures at different heights and different locations sideways across the backwall to accommodate various different fitting positions of the product receiving member on the hanger arm.

Figure 7:
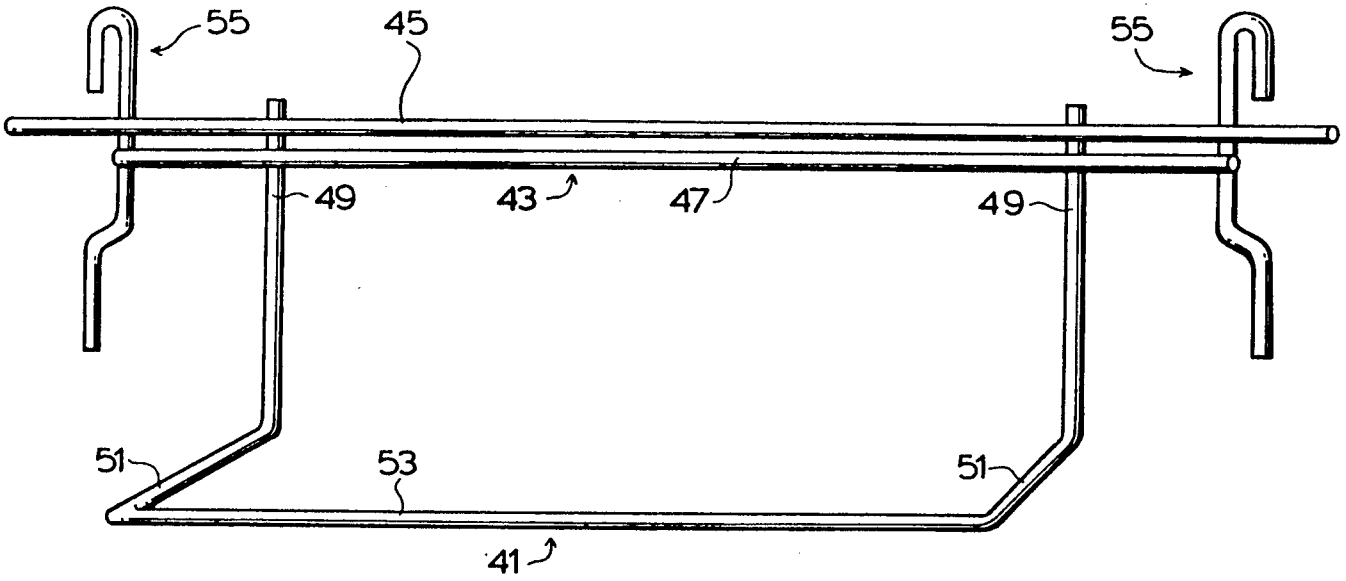
FIG. 7 is an enlarged perspective view of the base support member from the product merchandiser assembly of FIG. 1.

In the FIG. 1 arrangement, a hanger arm 23 is provided at each of the top boxes in the stacks to the left and the right hand side of the overall assembly. A bottom support 41 is also provided at the bottom of each stack although only one bottom support can be seen in the FIG. 1 set up. This bottom support best shown in FIG. 7 of the drawings, comprises a hanger arm generally indicated at 43 and formed by upper and lower arm portions 45 and 47 respectively. A mounting end 55 is provided to each side of the bottom support. Mounting end 55 is identical to and mounts in the same manner as mounting end 31 of arm 23. The reason that two mounting ends are provided, one at each side of the bottom support is to allow fitting of the bottom support for the stacks of boxes at either side of the shelf system.

Bottom support 41 further includes a stand formed by upright legs 49, horizontally extending side legs 51 at the bottom of each of the legs 49 and a further leg 53 at right angles to legs 51. This stand, which rests at ground level, provides a very stable base for the bottom support.

Hanger bar 43 of bottom support 41 is used to receive one of the clips 17 in the identical manner to that described with respect to the fitting of the clips to hanger arm 23. When the clip is fitted through the lower box in the stack as shown in FIG. 1, this prevents the entire stack from being pulled outwardly at its bottom end away from the shelf system.

Figure 8:
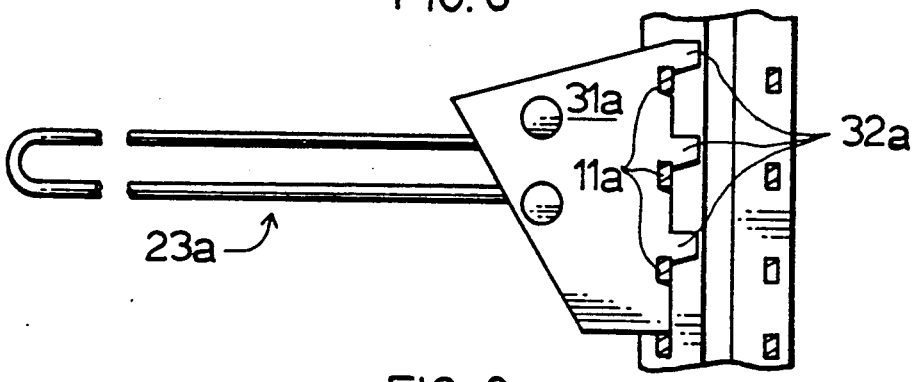
FIGS. 8 through 10 show different hanger arms from that shown in the assembly of FIG. 1.
Figure 9:
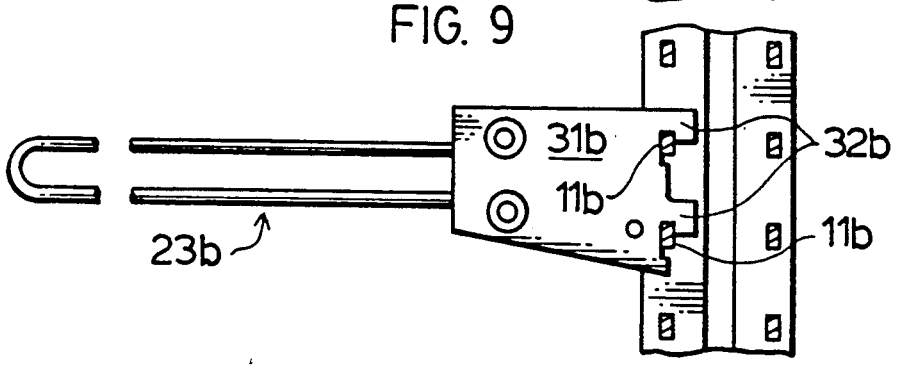

FIGS. 8 and 9 of the drawings, simply show modified hanger arms designed to fit with existing shelf systems slightly different from that shown in FIG. 2 of the drawings. For example, FIG. 8 shows hanger arm **23*a* having a mounting end 31*a* for fitting with a plurality of generally rectangular pegs or posts 11*a*. Mounting end 31*a* includes three rearward projections 32*a* having grooves which simply drop down onto the rectangular pegs or posts 11*a***.

FIG. 9 shows a hanger arm **23*b* very similar to hanger arm 23*a* except that arm 23*b* has a mounting end 31*b* including two grooved projections 32*b*. Once again, these grooved projections lock onto generally rectangular pegs or posts 11*b*. The difference between hanger arms 23*a* and 23*b* is that hanger arm 23*a* because of its added locking point is used to support a heavier load than hanger arm 23*b***.

Figure 10:
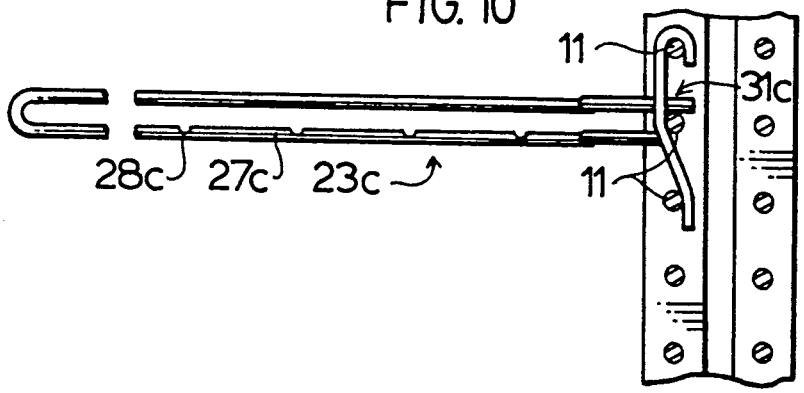

FIG. 10 shows a hanger arm **23*c*. This hanger arm is very similar to hanger arm 23 shown in FIGS. 2 through 4 of the drawings and includes a mounting end 31*c* which locks onto the pegs or posts 11 from the shelf system of FIGS. 1 and 2. The only difference between arm 23 and arm 23*c* is that the latter arm includes a lower arm portion 27*c* provided with a plurality of indents or recesses 28*c* for receiving one of the clips 17. The upwardly bent portions 20** of the clip drop down into these indents to prevent any undesired shifting or sliding of the clip along the hanger arm. At the same time, the clip can easily be lifted up and out of the indents to reset the positioning of the clip relative to the hanger arm if desired.

In all the description above, reference is made to a quickly and easily releasable mounting end on the hanger arm. It is to be appreciated that the hanger arm may be mounted in a much more permanent manner as for example a nut and bolt mounting or even a weld mounting of the inner end of the hanger arm to the support member for the hanger arm.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A product merchandiser assembly comprising a product receiving member having an apertured backwall, an elongated arm having a mounting end for mounting to an existing support and a hanger region extending from said mounting end into open space outwardly away from the existing support, and clip means for clipping through said apertured backwall of said product receiving member onto said hanger region of said arm, said hanger region of said arm having an opening for receiving said clip means, said opening being bordered by upper, lower and outer end arm portions of said hanger region trapping said clip means at said opening.

2. An assembly as claimed in claim 1, wherein said arm comprises upper and lower arm portions and having a closed outer end on said arm between said upper and lower arm portions.

3. An assembly as claimed in claim 2, including inner ends on said arm portions, said inner ends being vertically spaced from one another to provide a non-pivotal mounting of said mounting region to the support surface which holds the elongated arm in a horizontal position.

* * * * *